United States Patent [19]

Nomura

[11] Patent Number: 4,777,896

[45] Date of Patent: Oct. 18, 1988

[54] SEWING MACHINE FOR PERFORMING PATTERN-CORRECT SEWING

[75] Inventor: Etsuzo Nomura, Aichi, Japan

[73] Assignee: Brother Kogyo Kabushiki Kaisha, Aichi, Japan

[21] Appl. No.: 14,583

[22] Filed: Feb. 13, 1987

[30] Foreign Application Priority Data

Feb. 15, 1986 [JP] Japan ..... 61-31711

[51] Int. Cl.[4] ..... D05B 27/06; D05B 27/08

[52] U.S. Cl. ..... 112/314; 112/121.11; 112/320

[58] Field of Search ..... 112/314, 313, 312, 315, 112/316, 262.1, 121.11, 121.26, 272, 121.25, 320

[56] References Cited

U.S. PATENT DOCUMENTS

| | | | |
|---|---|---|---|
| 3,954,071 | 5/1976 | Mall et al. | 112/314 |
| 4,423,691 | 1/1984 | Schwaab | 112/272 |
| 4,574,719 | 3/1986 | Balke | 112/272 |
| 4,612,867 | 9/1986 | Rosch et al. | 112/314 |
| 4,658,741 | 4/1987 | Jehle et al. | 112/314 X |

*Primary Examiner*—Peter Nerbun

*Attorney, Agent, or Firm*—Finnegan, Henderson, Farabow, Garrett and Dunner

[57] ABSTRACT

Before sewing, a cloth pattern sensing means generates waveform signal corresponding to the overall width of two overlapping patterns corresponding to each other in two cloth pieces. The position difference between the patterns is calculated on the basis of the waveform signal. At least one of the feed pitches of the two cloth pieces is changed on the basis of data on the calculated amount of difference and data on the sensed cloth feed pitch. Data on the position difference amount between any patterns and the position difference amount between the next patterns are compared to calculate the direction in which the position difference amount increases or decreases, namely, the direction of the difference. Adjustment is made in the direction in which the amount of difference decreases on the basis of the result of calculation of the direction.

9 Claims, 12 Drawing Sheets

SEWING MACHINE FOR PERFORMING PATTERN-CORRECT SEWING

BACKGROUND OF THE INVENTION

This invention relates to a sewing machine which sews upper and lower cloth pieces having the same pattern together while maintaining correct alignment of the pattern.

Generally, in a conventional sewing machine, a skilled worker must put many hours and take great care in sewing together two cloth pieces having the same pattern to form the back body of a blazer for either a gentleman or a lady or to fasten the sleeves to the shoulders of the blazer body while maintaining correct alignment of the pattern.

U.S. Pat. No. 3,954,071 to Mall et al. discloses a sewing machine for sewing two material layers to each other in aligned positions. According to this sewing machine, although it is possible to counteract the misalignment of the material layers, it is impossible to perform the pattern-correct sewing together of two cloth pieces having the same pattern.

U.S. Pat. No. 4,612,867 to Rosch et al. discloses a sewing machine for sewing together two pieces of cloth while maintaining correct alignment of a pattern on the two pieces of cloth. In this sewing machine, a light source and a light sensor are provided for each of the upper and lower cloth pieces, and the mutual difference of the pattern of the two cloth pieces is determined by comparing sensing signals from each light sensor. However, this sewing machine is disadvantageous in that sensors must be provided for each of the upper and lower cloth pieces and a long time is required from the occurrence of the difference of the pattern to the disappearance of the difference.

The reason a long time is required is as follows: In this sewing machine, each sensor detects each pattern structure of upper and lower cloth pieces and the detected signals are converted to digital signals and are stored. A signal processing unit determines a momentary offset between the two cloth pieces and the direction of the offset based on the stored digital signals for each of the upper and lower cloth pieces by using cross-correlation function. In general, this operation of the signal processing unit requires a long time. Also, in this sewing machine, there is another problem, that is, the signal processing unit can not detect the offset until the pattern structures are fully detected.

SUMMARY OF THE INVENTION

Accordingly, it is an object of the invention to overcome the above disadvantages of the prior art.

It is another object of this invention to provide a sewing machine which is capable of easily and steadily sewing two upper and lower cloth pieces having the same pattern to each other in aligned positions, and that requires minimal skill to operate and that is inexpensively manufactured.

In order to achieve these objects, according to this invention, a sewing machine is provided comprising: stitch forming means including a needle movable up and down through a cloth support surface for sewing together two cloth pieces overlapped with each other, said cloth pieces having the same pattern, respectively; upper feeding means arranged over said cloth support surface for feeding the upper cloth piece, said upper feeding means being actuated synchronously with said stitch forming means; lower feeding means arranged under said cloth support surface for feeding the under cloth piece, said lower feeding means being actuated synchronously with said stitch forming means; feed adjusting means for adjusting at least one of feed pitches of said upper and under feeding means; cloth pattern sensing means for generating sensing signals, said cloth pattern sensing means being disposed at an upstream side of said stitch forming means and having a single light source irradiating said cloth pieces and a single light receiving element receiving composed rays of transmitted light or reflected light from said two cloth pieces; differentiating means for differentiating said sensing signals to produce differential signals; orithmetic means for calculating the amount of difference of position between said patterns on said two cloth pieces on the basis of polarities of two consecutive signals generated from said differentiating means and the timing of occurance of said signals; and control means for aligning said patterns on said two cloth pieces by controlling said feed adjusting means on the basis of the amount of difference of position between said patterns calculated by said arithmetic means.

Thus, before sewing, the cloth pattern sensing means generates a waveform signal corresponding to the overall width of the two patterns on the cloth pieces. The arithmetic means calculates the position difference between the cloth patterns on the basis of the signal. The control means controls the feed adjusting means on the basis of data on the position difference and data on the cloth feed pitch from the feed sensing means in one direction so that the amount of difference either increases or decreases to thereby change the cloth feed pitch of said feeding means. Further the control means compares data on the position difference between any patterns with the position difference between the next patterns in accordance with changing of the cloth feed pitch to calculate the direction in which the amount of position difference increases or decreases, namely, the direction of the difference, and adjusts said feed adjusting means in the direction in which said amount of position difference decreases on the basis of the result of the calculation, and stops said feed adjusting means when the amount of position difference falls within the tolerance.

BRIEF DESCRIPTION OF THE DRAWINGS

FIGS. 1–15 illustrate a first embodiment of this invention, wherein:

FIG. 1 is perspective view showing the internal structure of a sewing machine;

FIG. 2 is a side cross-sectional view showing a stitch forming device and a cloth pattern sensing means;

FIG. 3 is a partially enlarged cross-sectional view of a sensor for sensing the position of a sewing-machine needle and the rotating angle of the main machine shaft;

FIG. 4 is a cross-sectional view taken along the line 4—4 of FIG. 3;

FIG. 5 is a cross-sectional view taken along the line 5—5 of FIG. 3;

FIG. 6 is a partially enlarged perspective view of an upper-feed device;

FIG. 7 is a partial perspective view showing the feed adjusting device and feed sensor;

FIG. 8 is a side cross-sectional view of the device and sensor of FIG. 7;

FIG. 9 is a partially enlarged side cross-sectional view of an upper-feed adjusting device;

FIGS. 10(*a*) and 10(*b*) are partially enlarged perspective views of parts of the cloth pattern sensing means;

FIG. 11 is a plan view of the sewing machine in operation;

FIG. 12 is a block diagram showing the electrical structure of the sewing machine;

FIG. 13 is a flowchart showing the operation order of the sewing machine;

FIG. 14 is a graph showing the relationship among needle position, feed quantity percentage and rotating angle of the sewing machine main shaft;

FIGS. 15(*a*) and 15(*b*) illustrate various signals;

FIGS. 17 and 18 are flowcharts showing the operation order of the sewing machine; and FIG. 19 illustrates the relationship between patterns and signals.

DETAILED DESCRIPTION OF THE INVENTION

Now, a first embodiment of this invention will be described in detail with reference to FIGS. 1–15.

Stitch Forming Device

Figure 1:
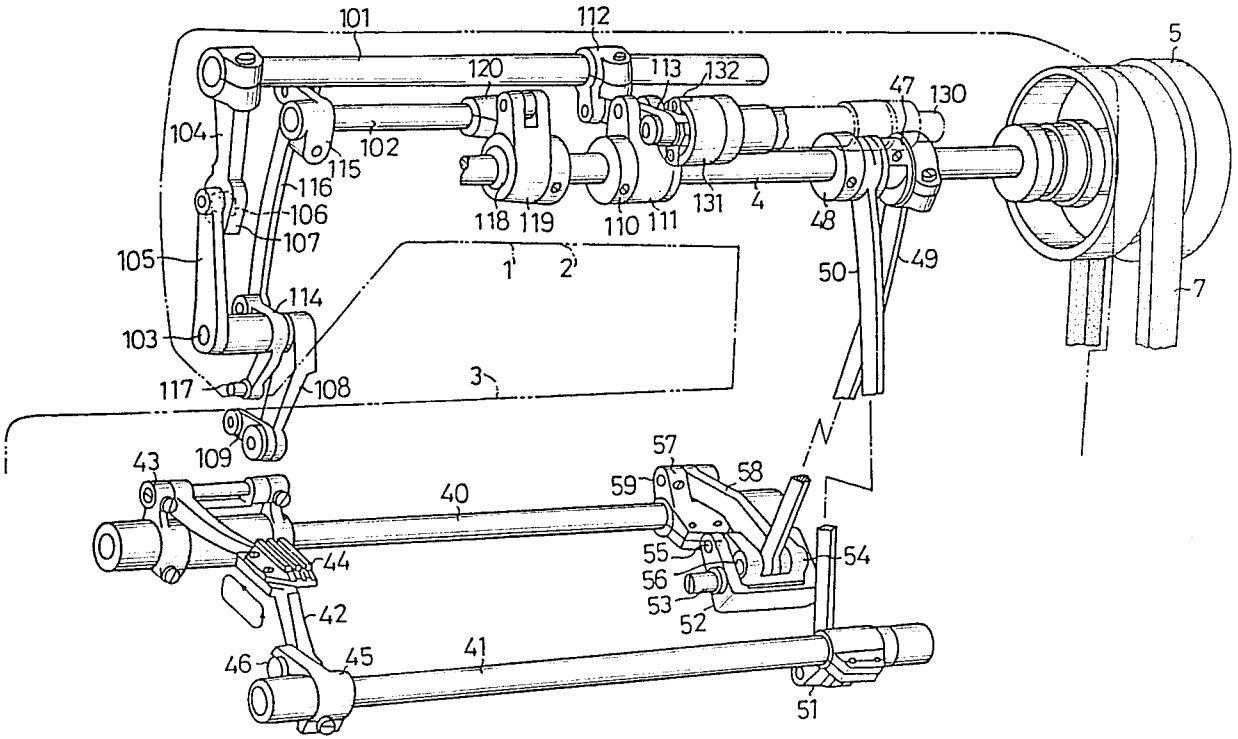
Figure 12:
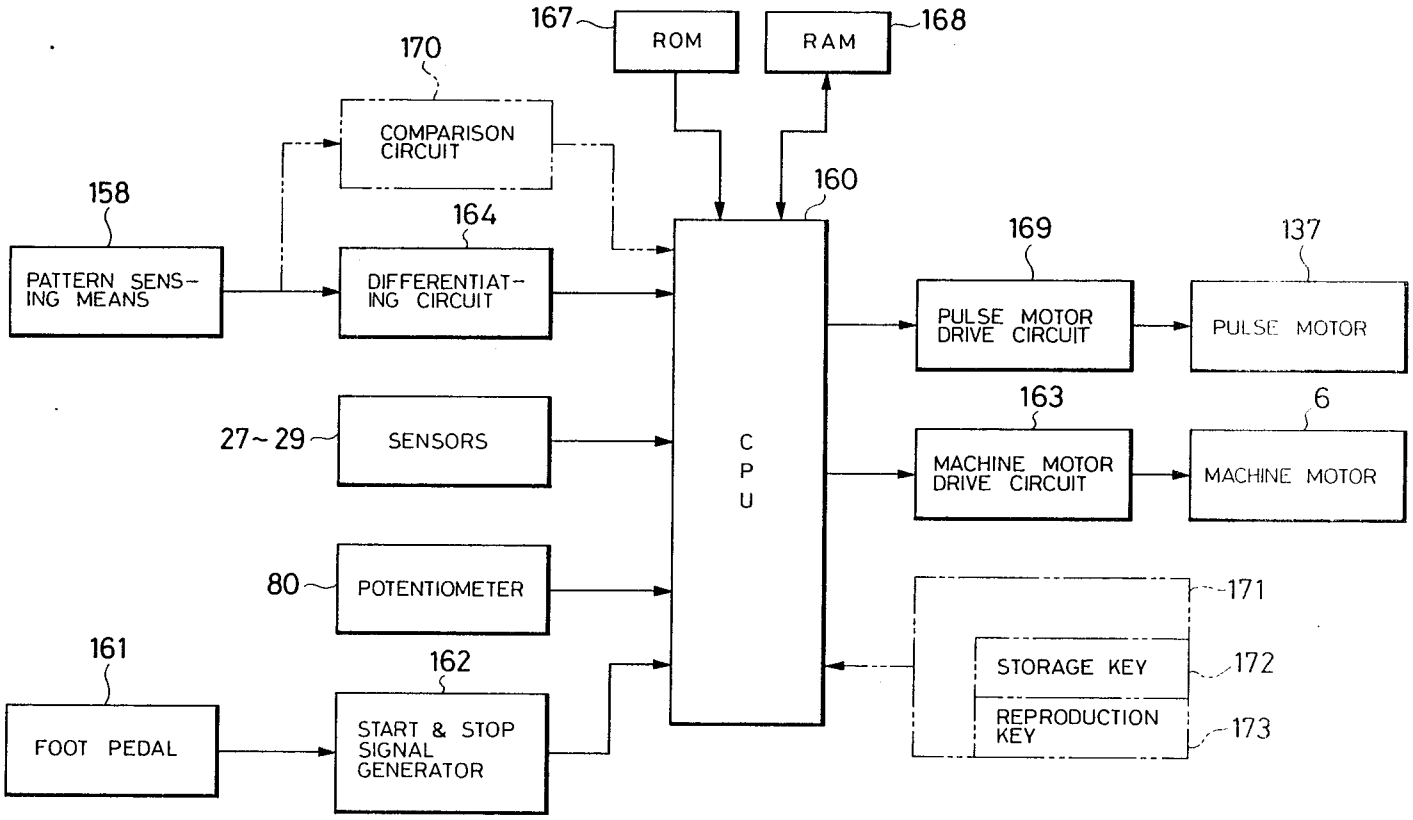

As shown in FIG. 1, a machine frame 1 includes an arm portion 2 and a bed portion 3. The arm portion 2 rotatably supports a main machine shaft 4 which mounts a driven pulley 5 at its right end. The torque of a machine motor 6, shown in FIG. 12, is transmitted via a belt 7 and the pulley 5, shown in FIG. 1, to the shaft 4 to rotate it.

Figure 2:
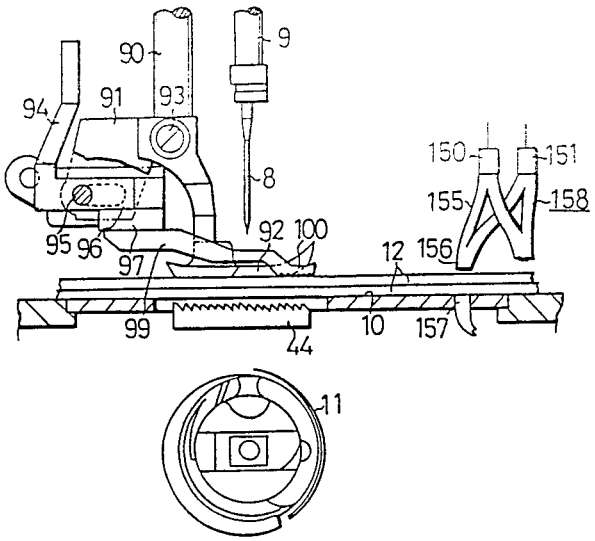
Figure 3:
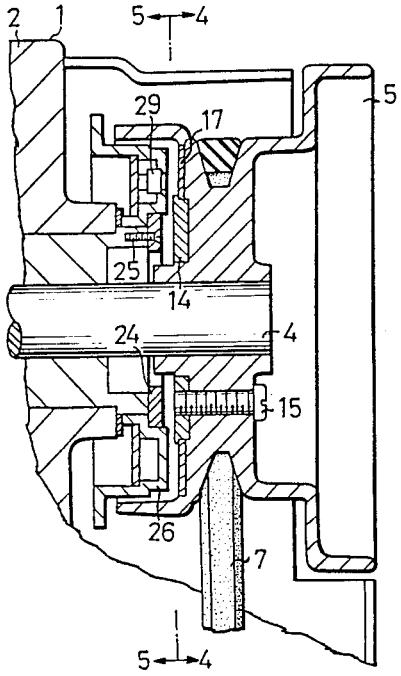
Figure 4:
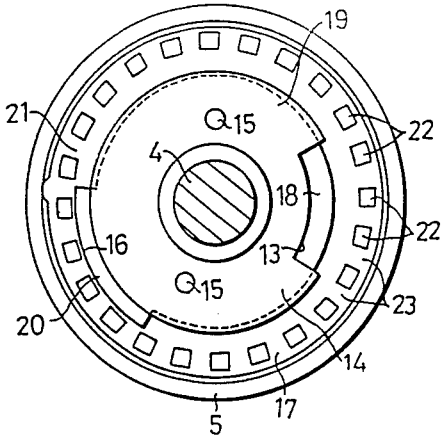
Figure 5:
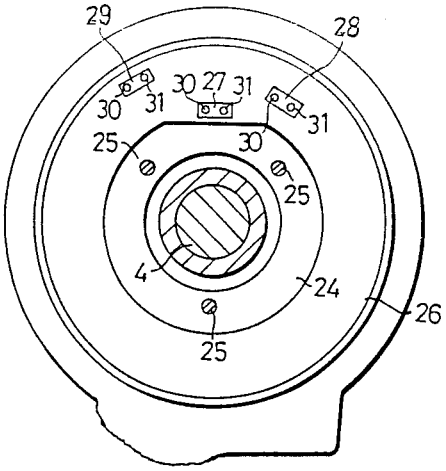

As shown in FIG. 2, the arm portion 2, shown in FIG. 1, supports a needle bar 9 having a needle 8 at its lower end, so that the needle rod can move up and down. When the main shaft 4 is rotated, the needle 8 is moved up and down through a cloth support surface 10 of the bed portion 3. A loop taker 11 is supported in bed portion 3 so that it can rotate around a horizontal axis and catches needle thread (not shown) carried by the needle 8 to form a thread loop. The thread loop is formed by rotation of the loop thread 11 synchronously with up-and-down movement of the needle 8. The loop causes the loop taker 11 to supply lower thread which then cooperates with the loop to form a stitch in two cloth pieces 12 on the cloth support surface 10.

The stitch forming device includes the needle 8 and the loop taker 11.

As shown in FIGS. 1 and 3–5, a first reflective plate 14 having an arcuate cut 13 along its outer periphery is attached by two screws 15 to the left side of the pulley 5. Attached between the outer periphery of the first reflective plate 14 and the side of the pulley 5 is a second ring-like reflective plate 17 having a cut 16 along its inner periphery. The respective cuts 13 and 16 of the plates 14 and 17 are disposed at a spacing of about 180 degrees. The area defined by the cut 13 and the inner periphery of the second reflective plate 17 constitutes a non-reflective surface 18 for sensing the upper-position of the needle while the surface of the first reflective plate 14 positioned concentric with the non-reflective surface 18 constitutes a reflective surface 19. On the other hand, the cut 16 in the second reflective plate 17 and the outer periphery of the first reflective plate 14 defines an area which constitutes a non-reflective surface 20 for sensing the lower position of the needle. The surface of the second reflective plate 17 positioned concentric with the non-reflective surface 20 constitutes a reflective surface 21. The surface of the second reflective plate 17 has non-reflective surfaces 22 and reflective surfaces 23 disposed alternately at predetermined angular spacings outwardly of the cut 16.

A support body 26 is mounted by three screws 25 through a mounting plate 24 within the arm portion 2 so as to be situated outwardly of the main shaft 4 in proximity to the respective plates 14, 17. Sensors 27, 28 and 29 are mounted on the support body 26 opposed to the non-reflective surfaces 18, 20, 22 and sense the upper position of the needle, the lower position of the needle and a rotating angle, respectively. Each of sensors 27–29 includes a light emitting element 30 and a light receiving element 31. When the pulley 5 is rotated, the light emitted from the light emitting element 30 is reflected by the reflective surfaces 19, 21 and 23 and absorbed by the non-reflective surfaces 18, 20 and 22. If no reflected light enters the respective light receiving element 31, the respective sensors 27–29 output a needle upper-position sensing signal, a needle lower-position sensing signal and a synchronous signal SG1 (see FIG. 14), while when the reflected light is entered, no such signals are outputted.

Lower Feeding Device

Next, a lower feeding device which is engaged with the lower surface of the lower one of the two cloth pieces 12 to apply a feed to the lower cloth piece, will be described. As shown in FIG. 1, rotatably supported within the bed 3 of the machine frame 1 are a horizontal-feed shaft 40 and a vertical-feed shaft 41, both of which extend horizontally. A feed bar 42 is rotatably supported at the left end of the horizontal-feed shaft 40 by means of a support arm 43. On the bar 42 is attached a lower-feed dog 44 which can appear above the cloth support surface 10 of the bed 3. Attached to the left end of the vertical-feed shaft 41 is an engagement arm 45 having a bifurcate end which is engaged with a forward engagement end 46 of the feed bar 42. As the main shaft 4 is rotated, the horizontal-feed shaft 4 and the vertical-feed shaft 41 perform a reciprocal movement, so that the lower-feed dog 44 is caused to perform a four-motion feed, as shown by the circular arrow, thereby applying a feed to the lower cloth piece 12 on the support surface 10.

In more detail, as shown in FIG. 1, mounted on the main shaft 4 are the horizontal-feed and the vertical-feed eccentric cams 47, 48 on which crank rods 49, 50 are mounted at their upper ends in an embracing manner. The vertical-feed crank rod 50 is coupled at its lower end via a coupling arm 51 to the vertical-feed shaft 41. As the vertical-feed eccentric cam 48 is rotated, the vertical-feed shaft 41 is caused to perform a reciprocating turn by means of the crank rod 50 within a predetermined range.

Figure 8:
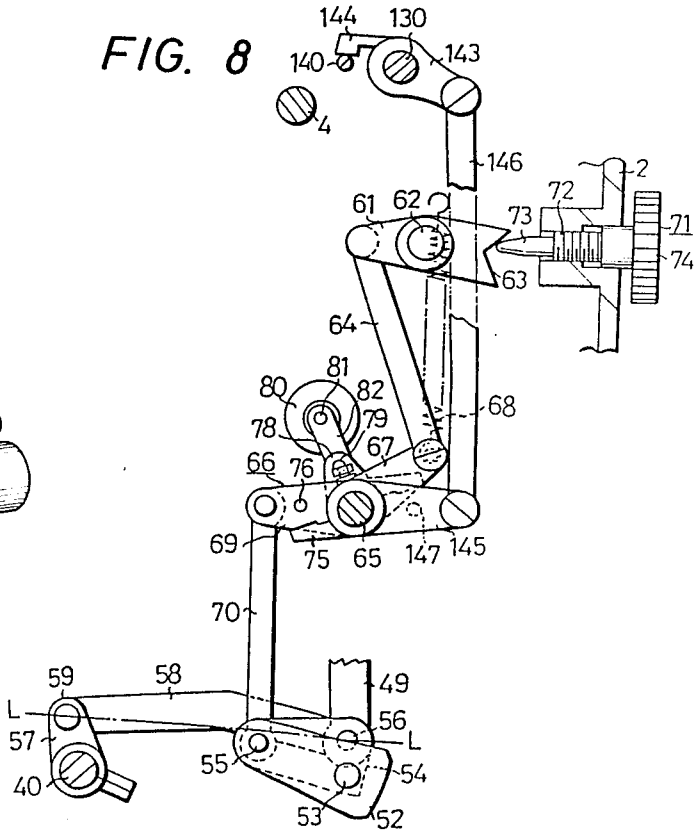

On the other hand, as shown in FIGS. 1 and 8, a substantially U-like feed regulator 52, corresponding to the lower end of the horizontal-feed crank rod 49, is rotatably supported by a support shaft 53 within the bed 3. A horizontal-feed link 54 is rotatably supported at its backward end by a support pin 55 to a backward end of the feed changer 52. The horizontal-feed crank rod 49 is rotatably coupled at its lower end to a support shaft 56 disposed inside the horizontal-feed link 54. A link 58 is rotatably coupled at its back end to the horizontal-feed shaft 40 by means of a coupling arm 57 and a coupling shaft 59 so that it is opposed to the support shaft 56. The link 58 is rotatably coupled at its tip end to the support shaft 56. When the horizontal-feed shaft eccentric cam 47 is rotated by rotational adjustment of the feed regulator 52 around the support shaft 53 in the state of the support shaft 55 being set to a predetermined position, the horizontal-feed link 54 is caused to perform a reciprocating turn around the support shaft 55 via the crank rod 49. Thus, a rotational torque in the back and forth direction is applied via the link 58 to the coupling arm 57 in accordance with the position where the support shaft 55 is set, so that the horizontal-feed shaft 40 is caused to perform a reciprocating turn within a predetermined range.

The lower-feed device includes the eccentric cams 47, 48, the crank rods 49, 50, the horizontal-feed link 54, the link 58, the horizontal-feed shaft 40, the vertical-feed shaft 41, the feed bar 42 and the lower-feed dog 44.

Lower-Feed Adjustment Device and Feed Sensing Device

The lower-feed adjustment device which adjusts the turn of the feed regulator 52 to change and set the feed pitch and feed direction of the lower cloth piece by the lower-feed dog 44, will be described.

Figure 7:
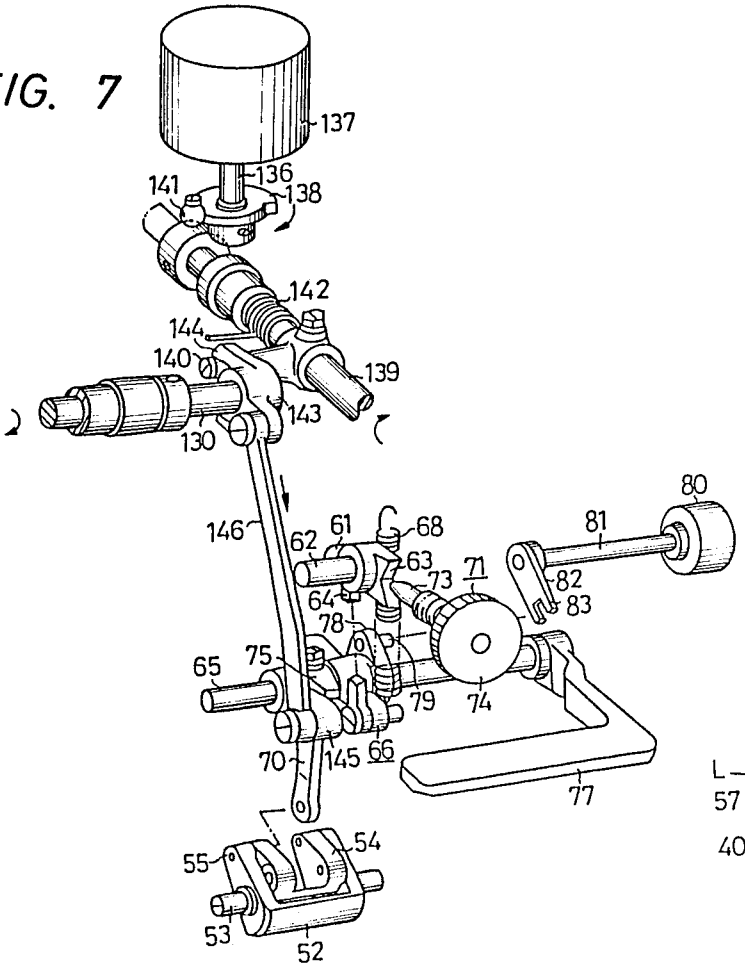

As shown in FIGS. 7 and 8, a feed adjustment member 61 is rotatably supported substantially at its center by a support shaft 62 within the arm portion 2 of the machine frame 1. The adjustment member 61 has a V-like feed control cam 63 at its forward end. A coupling rod 64 having the lower end extending downword is rotatably connected at its upper end to the back end of the feed adjustment member 61. A horizontally extending operating shaft 65 is rotatably supported within the arm portion 2 in the vicinity of the lower end of the coupling rod 64. A three-arm-like engagement member 66 is fitted at its middle portion over the operating shaft 65 so as to permit relative rotation. The coupling rod 64 is rotatably coupled at its lower end to a first arm 67 of the engagement lever 66. The engagement lever 66 is biased by a spring 68 engaged with the first arm 67 so as to rotate counterclockwise as viewed in FIG. 8. A second arm 69 of the engagement lever 66 is coupled via the coupling rod 70 to the support pin 55.

The feed adjustment member 61 is biased clockwise in FIG. 8 by the action of the spring 68 and normally disposed at a predetermined position shown in FIG. 8. On the other hand, when the feed adjustment member 61 is turned counterclockwise in FIG. 8 against the action of the spring 68, the feed regulator 52 is turned clockwise via the coupling rod 64, the lever 66 and the coupling rod 70. At this time, when the axis of the support pin 55 approaches the straight line L—L connecting the support shaft 56 and the coupling shaft 59, the cloth feed pitch is reduced. When the axis of the support pin 55 is moved upwardly beyond the straight line L—L, the direction of cloth feed is reversed.

As shown in FIGS. 7 and 8, a manually operated member 71 is rotatably screwed at its middle threaded portion 72 into the arm portion 2 of the machine frame 1. A shaft 73 is provided at the inner end of the feed adjustment member 61 so as to engage with a feed control cam 63 of the feed adjustment member 61 to hold the member 61 at a predetermined position against the action of the spring 68. A large-diameter operated member 74 is provided at the outer end of the feed adjustment member 61.

When the operated portion 74 of the manually operated member 71 is manually turned to move the member 71 back and forth, the tilt angle of the feed adjustment member 61 is altered via the engaged shaft 73 and the feed control cam 63, and the cloth feed pitch is thereby changed, as described above.

An operating lever 75 is securely fixed to the middle portion of the operating shaft 65 in the vicinity of the engagement lever 66 so as to turn integrally with the operating shaft 65. The rear end of the lever 75 is opposed to the lower portion of an engagement pin 76 protruding from the left side of the second arm portion 69 of the engagement lever 66. An operated lever 77 is attached to the right end of the operating shaft 65 outside the arm portion 2 of the machine frame 1. When the operated lever 77 is pressed down to rotate the shaft 65 and the lever 75 clockwise in FIG. 8, the lever 75 is engaged with the engagement pin 76, so that the feed regulator 52 is turned via the coupling rod 70 to a feed reversing position, thereby reversing the cloth feed direction.

Protruding from a third arm portion 78 of the engagement lever 66 is a coupling pin 79 which is opposed to a feed sensor including a potentiometer 80 disposed on the frame arm portion 2 of the machine frame 1. A coupling lever 82 is securely fixed at its base end to a tip end of a turning shaft 81 of the potentiometer 80. A bifurcate portion 83 formed at a tip end of the lever 82 is engaged with the engagement pin 79. When the engagement lever 66 is turned, the turning shaft 81 is turned via the coupling pin 79 and the lever 82, and a cloth feed pitch sensing signal corresponding to the quantity of rotation of the shaft 81 is output from the potentiometer 80.

It is to be noted that the lower-feed adjustment device includes the manually operated member 71, the feed adjustment member 61, the coupling rod 64, the engagement lever 66, the engagement rod 70 and the feed regulator 52.

Upper-Feed Device

Figure 6:
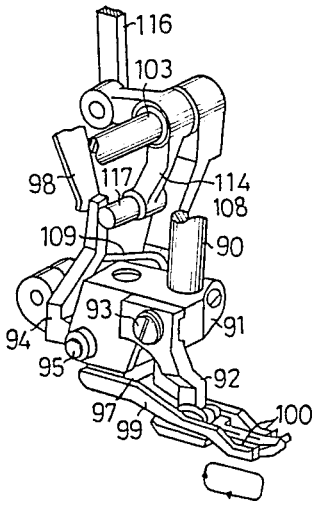

Now, an upper-feed device which applies a feed to the upper piece of cloth 12 by engaging the upper surface thereof will be described. As shown in FIGS. 2 and 6, a pressure bar 90 is supported by the arm portion 2 of the machine frame 1 so that it can move vertically. It is also biased downwardly by a spring (not shown). An upper-feed base 91 having a substantially U-like cross-section is securely fixed to the lower end of the press rod 90. A pressure foot 92 is attached by a screw 93 to the outer side of the pressure bar 90. When the pressure bar 90 is moved downwardly, a pressure foot 92 presses the cloth pieces 12 against the cloth support surface 10.

A substantially L-like vertical-feed lever 94 is pivotably supported at its middle portion via a support shaft 95 to a back portion of the upper-feed base 91, and a forward guide portion 96 of the lever 94 is disposed within the upper-feed base 91. The vertical-feed lever 94 is biased clockwise in FIGS. 2 and 6 by a leaf spring 98 engaged with the upper rear surface of the lever 94. Within the upper-feed base 91, a moving body 97 is supported at the guide portion 96 so as to move back and forth, and an upper-feed dog 99 is securely fixed at its rear end to the lower surface of the moving body 97. Teeth 100 are formed at the front end of the upper-feed dog 99 on each side of the pressure foot 92. The upper-feed dog 99 performs a four-motion feed in accordance with a reciprocating turn of the vertical-feed lever 94 and a forward and backward movement of the moving body 97.

Now, the structure which applies a four-motion feed to the upper-feed dog 99 will be described. As shown in FIG. 1, a swing shaft 101 and an operating shaft 102 which extend parallel to the main shaft 4 are swingably supported within the arm portion 2 of the frame 1. A support shaft 103 is pivotably supported within the arm portion 2 between the swing shaft 101 and the upper-feed base 91. Swing levers 104 and 105 are attached to the left ends of the shafts 101 and 103, respectively, so as to swing therewith. A rectangular piece 106 provided on an upper end of the lower swing lever 105 is engaged with a bifurcate portion 107 formed at the lower end of the upper swing lever 104.

A swing arm 108 is securely fixed at its upper end to the right end of the support shaft 103 so as to turn integrally therewith. The swing arm 108 is also coupled at its lower end via a link 109 to the rear end of the moving body 97. On the other hand, an eccentric cam 110 for horizontal-feed is mounted at a middle portion of the main shaft 4. A crank rod 111 is mounted at its lower end to the eccentric cam 110 in an embracing manner. A coupling arm 112 is securely fixed to the swing shaft 101 opposed to the upper end of the crank rod 111, the lower end of the coupling arm 112 is pivotably coupled to the rear end of a link 113, and the upper end of the crank rod 111 is pivotably connected to a middle portion of the link 113.

The swing shaft 101 is caused to perform a reciprocating turn within a predetermined range via the crank rod 111, the link 113 and the coupling arm 112 by turning of the eccentric cam 110. This causes the moving body 97 to move back and forth via the swing levers 104, 105, the support shaft 103, the swing arm 108 and the link 109.

A two-arm-like lever 114 is pivotably supported at a middle portion of the support shaft 103. A coupling lever 116 is pivotably coupled at its upper end via a coupling arm 115 to the left end of the operating shaft 102. The lower end of the coupling lever 116 is pivotably coupled to a rear end of the lever 114. The lever 114 has at its lower end an engagement pin 117 which is engaged from backward with the upper end of the vertical-feed lever 94.

On the other hand, an eccentric cam 118 for vertical upper feed is mounted to the main shaft 4 in the vicinity of the horizontal-feed eccentric cam 110. A crank rod 119 is mounted at its lower end to the eccentric cam 118 in an embracing manner. The coupling arm 120 secured to the right end of the operating shaft 102 is pivotably coupled at its front end to the upper end of the crank rod 119. When the eccentric cam 118 is turned, the crank rod 119 is moved up and down within a predetermined range, so that the operating shaft 102 is caused to perform a reciprocating swing via the coupling arm 120. As a result, the lever 114 is caused to perform a reciprocating swing via the coupling arm 115 and the coupling lever 116. This movement is transmitted via the engagement pin 117 to the vertical-feed lever 94.

It is to be noted that the upper-feed device includes the eccentric cams 110, 118, the crank rods 111, 119, the swing shaft 101, the operating shaft 102, the vertical-feed lever 94, the moving body 97 and the upperfeed dog 99.

Upper-feed Adjustment Device

Figure 9:
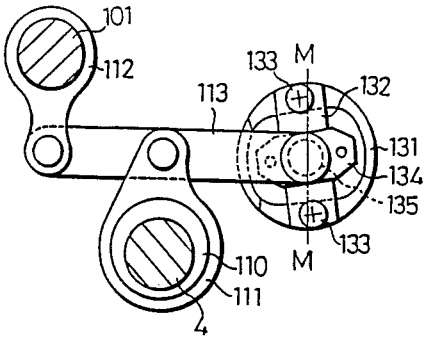

Now, the upper-feed adjustment device which changes and sets the quantity and direction of cloth feed by the upper-feed dog 99 will be described. As shown in FIG. 1, a rotating shaft 130 extending parallel to the main shaft 4 is pivotably supported at a forward portion of the main shaft 4. A bottom cylindrical feed regulator 131 is securely fixed at its bottom to the left end of the shaft 130. As shown in FIG. 9, a rectangular rod-like moving guide body 132 is fixed by screws 133 to the edge of an opening in the feed regulator 131. A slider 134 is movably supported at the guide body 132. The link 113 is pivotably coupled at its outer end to a support pin 135 provided at the outer surface of the slider.

As shown in FIG. 9, the feed regulator 131 is normally disposed at a predetermined position. When the regulator 131 is rotated clockwise in FIG. 9 along with the rotating shaft 130 and as the angle between the center line of the moving guide body 132 and a reference line M—M decreases, the cloth feed pitch is reduced. After the direction in which the moving guide body 132 is inclined is reversed from that shown in FIG. 9, the direction of cloth feed is reversed.

As shown in FIGS. 7 and 8, a pulse motor 137 which has an output shaft 136 extending orthogonally to the turning shaft 130 is provided at the arm portion 2 of the machine frame 1 in the vicinity of the right end of the turning shaft 130. A feed control cam 138 is mounted on the output shaft 136 of the pulse motor 137. An operating shaft 139 extending orthogonal to the operating shaft 130 is pivotably supported within the arm portion 2 so as to be positioned between the pulse motor 137 and the turning shaft 130. An engagement protrusion 140 protruding to the left direction is mounted on the outer forward periphery of the operating shaft 139 while a cam follower 141 engageable with the feed control cam 138 is mounted on the outer back periphery of the shaft 139. The operating shaft 139 is biased clockwise in FIG. 7 by a spring 142 and cam follower 141 is engaged with the feed control cam 138 by the action of the spring 142.

A two-arm-like swingable lever 143 is securely fixed at its middle portion to the right end of the turning shaft 130 in the vicinity of the engagement protrusion 140 while the rear engagement portion 144 of the lever 143 is engaged from above with the engagement protrusion 140. On the other hand, in FIGS. 7 and 8, a coupling arm 145 is pivotably supported on an operating shaft 65 to the left of the operating lever 75. The front end of the coupling arm 145 is coupled by a coupling link 146 to the front end of the rotating lever 143. This coupling arm 145 is biased counterclockwise in FIG. 8 by a spring (not shown), and the swingable lever 143 is biased by the action of the spring via the engagement link 146 in the direction in which the swingable lever 143 is engaged with the engagement protrusion 140.

The coupling arm 145 has an engagement pin 147 at its right side which is disposed opposite the lower surface of a front arm portion of the operating lever 75.

The feed control cam 138 is turned clockwise in FIG. 7 by the pulse motor 137 shown in FIG. 7. When the operating shaft 139 is turned clockwise in FIG. 7 by the engagement between the cam 138 and the cam follower 141, the swingable lever 143 and the turning shaft 130 are turned clockwise in FIG. 9 by the action of a spring (not shown) which biases the coupling arm 145 so as to turn, so that a cloth feed pitch is reduced, as described above.

When the operated lever 77 is pressed down, as described above, the direction of cloth feed by the lower-feed device is reversed. Simultaneously, the feed regulator 131 is turned to a feed reversing position along with the turning shaft 130 via the operating shaft 65, the operating lever 75, the coupling arm 145, the coupling link 146 and the swingable lever 143 and thus the direction of cloth feed is reversed.

It should be noted that the upper-feed adjustment device includes the pulse motor 137, the feed control cam 138, the cam follower 141, the operating shaft 139, the rotating shaft 130 and the feed regulator 131.

Cloth Pattern Sensing Means

Figure 11:
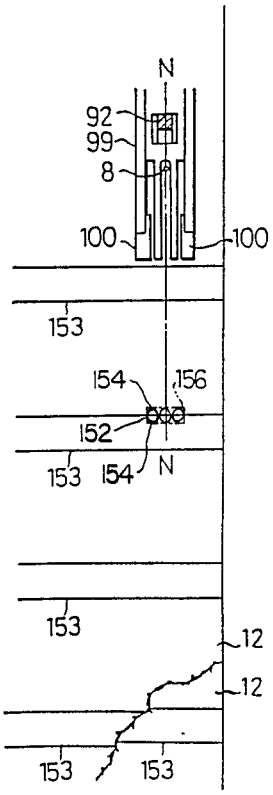
Figure 10A:
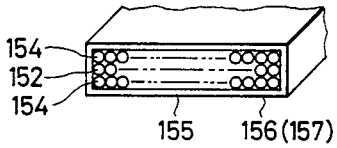
Figure 10B:
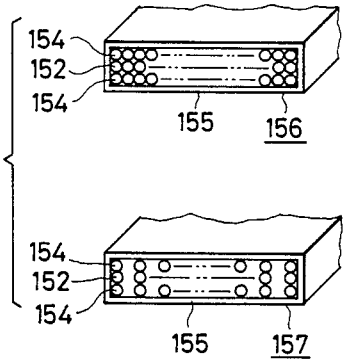

As shown in FIGS. 2 and 11, a single light source 150 including a lamp and a single light receiving element 151 are disposed above the bed 3 of the machine frame 1 on the upstream side of the needle 8. Light projecting-side light guides 152 of optical fibers, which form optical paths, are disposed between a predetermined position on a stitch forming line N-N at the upstream side of the point where the needle falls and the light source 150, to irradiate the upper surface of the upper cloth piece 12 and the lower surface of the lower cloth piece 12 by split rays of light from the light source 150. As shown in FIGS. 2 and 10, the end portions of the guides 152 at the cloth piece side are disposed close to the upper and lower surfaces of the cloth pieces 12 and are disposed on a line.

Light receiving-side light guides 154 of optical fibers forming optical paths are disposed between the previously mentioned predetermined position and the light receiving element 151, in order to split the rays of light reflected from the upper and lower surfaces of the cloth pieces 12 at the same percentage as that described above at the side of the cloth piece and to make the total light received by the light receiving element 151. As shown in FIG. 10, the cloth side ends of each of the light receiving side light guides 154 are disposed at both sides of the light projecting side light guide 152 in a divided state and on a line along the arranging direction of the light projecting side light guide 152. Each of light guides 152, 154 is bundled at each cloth piece side so as to form upper and lower light projecting and receiving units 156, 157, with a covering flexible film 155. The light projecting and receiving units 157 at the lower side of the cloth pieces is exposed through the bed portion 3 of the machine frame 1 over the cloth support surface 10. In addition, each of the light projecting and receiving units 156, 157 is disposed so as to permit positional adjustment in the direction in which the patterns 153 extend, and the cloth side ends of the light guides 152, 154 can be disposed in the direction in which the patterns 153 extend.

Figure 14:
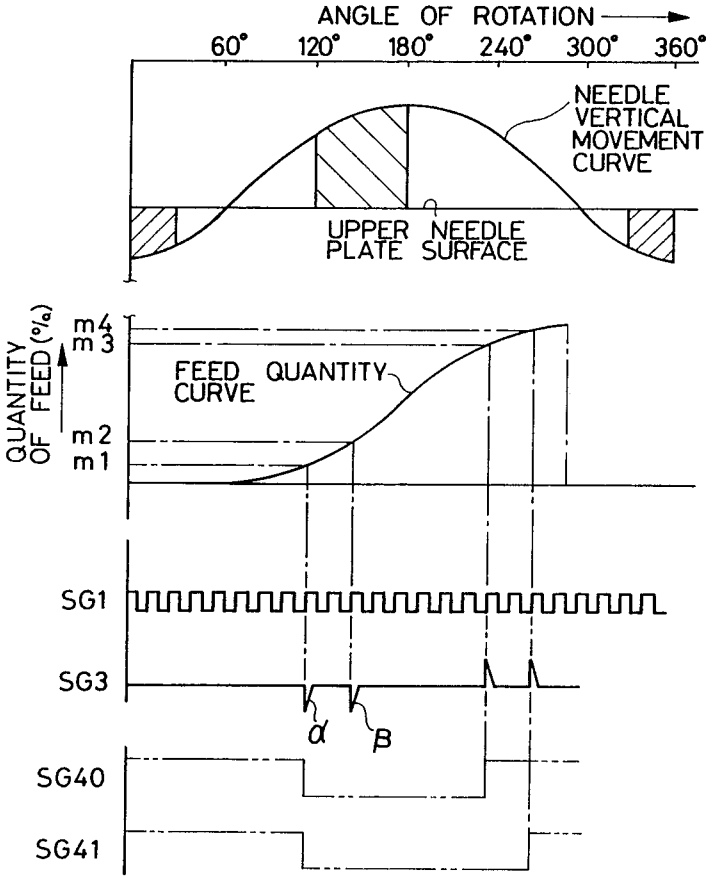

Cloth pattern sensing means 158 includes the single light source 150, the single light receiving element 151, and the light guides 152, 154. During feeding of the two cloth pieces 12, a portion of the light irradiating the cloth pieces 12 through the light projecting-side light guides 152 from the light source 150, i.e., the light reflected by the cloth pieces 12, is guided through the light receiving-side light guides 154 to the light receiving element 151. A portion containing the pattern 153 in the cloth piece 12 and a non-pattern portion are different in reflection factor, so that the quantity of light received by the light receiving element 151 varies depending on the presence/absence of the pattern 153. Thus, in accordance with the feeding movement of the cloth piece 12, the light receiving element 151 outputs a voltage waveform signal SG2 corresponding to the overall width of the overlapping patterns 153 on the upper and lower cloth pieces 12, as shown in FIG. 14.

Control Circuit

Next, the machine control circuit in this embodiment will be described with reference to FIG. 12.

A central processing unit (CPU) 160 forms control means and arithmetic means. It receives a start signal and a stop signal from a start and stop signal generator 162 in accordance with the operating of a foot pedal 161. The CPU 160 controls the driving of a machine motor 6 via a drive circuit 163. The CPU 160 receives a needle upper-position sensing signal, a needle lower-position sensing signal and a synchronous signal SG1 shown in FIG. 14 from the respective sensors 27–29 and cloth feed pitch data from the potentiometer 80.

A voltage waveform signal SG2 output from the cloth pattern sensing means 158 is processed by a differentiating circuit 164. The CPU 160 determines that there is no difference between the positions of patterns 153 when the level of the first generated signal and the next generated signal level (polarity) are different from each other in the signal SG3 (see FIG. 15) output from the differentiating circuit 164. When two consecutive signals having the same lever occur, the CPU 160 determines that there is a difference between the positions of the patterns 153.

Figure 13:
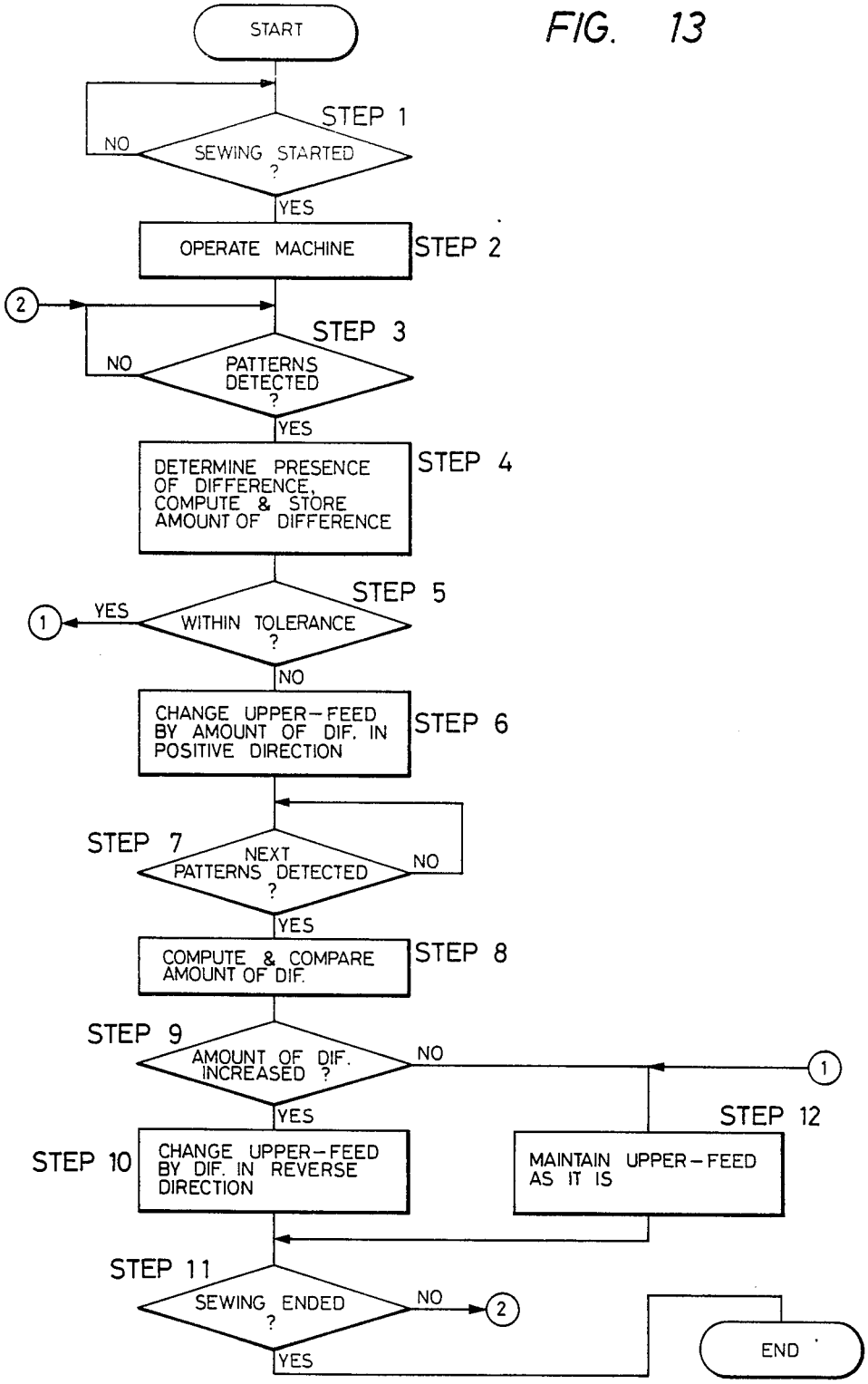

As shown in FIG. 12, a read only memory (ROM) 167 conneccted to the CPU 160, stores a program corresponding to the flowchart of FIG. 13, various other programs for controling the operation of the entrie machine, and data on a cloth feed pitch corresponding to the synchronous signal SG1 as shown in FIG. 14.

When the presence of a difference is determined on the bases of differentiation signals SG3 from the differentiating circuit 164, as shown in FIG. 14, the CPU 160 counts the number of input synchronous signals SG1 until two differentiation signals SG3 occur on the basis of a needle lower-position sensing signal, and the percentages of cloth feed pitch m1, m2 at the time when the respective differentiation signals SG3 are produced, are computed on the basis of the result of the counting from data on cloth feed pitch stored in the ROM 167. The CPU 160 then computes a difference x in accordance with the equation $x=(m2-M1)\cdot p$ from the computed data and data on the quantity of cloth feed (pitch, p) input from the potentiometer 80 and stores the result of the computation in the RAM 168.

When the presence of a difference is determined, the CPU 160 first drives the pulse motor 137 via a pulse motor drive circuit 169 on the basis of the data on the difference in the direction in which the cloth feed pitch increases (positive direction) to operate the upper-feed adjustment device to increase the cloth feed pitch by the upper-feed device in consideration of the fact that although the cloth feed pitch by the upper- and lower-feed dog 99 and 44 are set to the same value, there is a tendency that the cloth feed pitch by the upper-feed dog 99 will decrease in real sewing.

Next, when the CPU 160 determines that the amount of difference between the positions of the second detected patterns 153 is larger than the amount of difference between the positions of the first detected patterns 153, it drives the pulse motor 137 in the direction in which the cloth feed pitch is decreased (reverse direction) to reduce the cloth feed pitch by the upper-feed device. When the amount of difference is decreased to within a predetermined range, the CPU 160 stops the pulse motor 137.

Next, the operation of the sewing machine having the above structure will be described. First, as shown in FIGS. 2 and 11, two cloth pieces 12 having the same pattern 153 are set on the cloth support surface 10, and the pressure foot 92 is lowered to press the cloth pieces 12 against the surface 10. Then, the respective light projecting and receiving units 156, 157 are adjusted in position so that the cloth side ends of the light guides 152, 154 are disposed in the direction in which the patterns 153 extend.

Under these circumstances, when the foot pedal 161 shown in FIG. 12 is depressed to start sewing at step 1 in FIG. 13, the CPU 160 drives the machine motor 6 via the drive circuit 163 to drive the sewing machine at step 2.

This causes the main machine shaft 4 shown in FIG. 1 to rotate to thereby move the needle 8 up and down as well as to rotate the loop taker 11, and both the member 8 and 11 cooperate to form a stitch in the cloth pieces 12. As described above, when the machine shaft 4 is rotated, the horizontal- and vertical-feed eccentric cams 47 and 48 apply horizontal and vertical movements to the feed bar 42 and these movements are composed so that the lower-feed dog 44 performs a four-motion feed, as shown in FIG. 1.

The horizontal upper-feed eccentric cam 110 applies a horizontal movement to the moving body 97 while the vertical upper-feed eccentric cam 118 applies a vertical movement to the front end of the moving body 97 via the vertical-feed lever 94. These movements are composed so that the upper-feed dog 99 performs a four-motion feed synchronously with the lower-feed dog 44, as shown in FIG. 6. Thus, both feed dog 44, 99 apply feeds to the two cloth pieces 12.

During this operation of the machine, the potentiometer 80 shown in FIG. 7, outputs a signal corresponding to the tilt angle of the feed adjustment member 61, namely, a predetermined cloth feed pitch. The CPU 160 stores in the RAM 168 data on the quantity of cloth feed (pitch, p) on the basis of that signal. The respective cloth pieces 12 are irradiated with the light emanated from the light source 150 of the cloth pattern sensing means through the light projecting-side light guides 152, and the light reflected by the two cloth pieces 12 are received by the light receiving element 151 through the light receiving-side light guides 154.

When the respective pattern 153 passes through the cloth pattern sensing means 158, the result of the determination at step 3 becomes YES, so that control process to step 4. Namely, the cloth pattern sensing means 158 outputs a voltage waveform signal SG2 shown in FIG. 15 in accordance with the overall width of the overlapping patterns 153 on the upper and lower cloth pieces 12 and the signal SG2 is input to the differentiating circuit 164 where the voltage waveform signal SG2 is converted to a differentiation signal SG3.

Figure 15A:
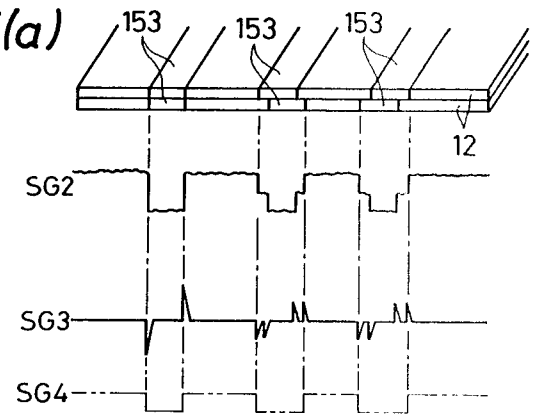
Figure 15B:
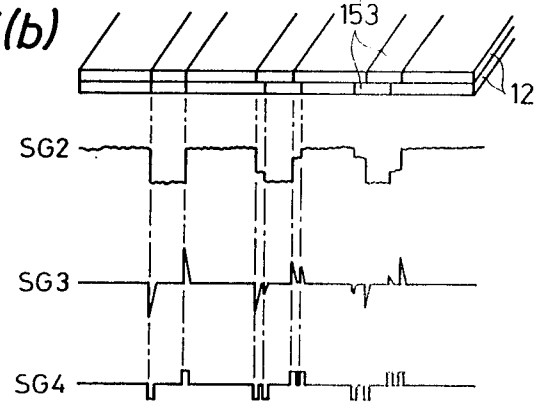

At step 4, the CPU 160 determines the presence of a difference of position on the basis of the differentiation signal SG3. When the presence of a difference is determined, the CPU 160 counts the number of input synchronous signals SG1 until two differentiation signals SG3 having the same level shown in FIG. 15 are produced on the basis of a needle lower-position sensing signal, and computes the percentages m1, m2 of the cloth feed pitch at the time when the respective differentiation signal SG3 occurs, from data on the cloth feed pitch stored in the ROM 167 on the basis of the result of the counting. That is, the CPU 160 stores the counted value of the synchronous signal SG1 counted on the basis of the needle lower position at the time when the first differentiation signal SG3 (shown by $\beta$ in FIG. 14) is produced and at the time when the second produced. The CPU 160 computes and stores the percentages m1 and m2 of the cloth feed pitch on the basis of the both counted values only when the levels (polarities) of both signals SG3 ($\alpha$,$\beta$) are equal to each other. The CPU 160 computes a difference x on the basis of the equation $x=(m2-m1)\cdot p$ from the computed data and the data on the quantity of cloth feed (pitch, p) input from the potentiometer 80 and stores the result of the computation in the RAM 168. On the other hand, the CPU 160 determines the difference x as zero when the levels (polarities) of the two differentiation signals SG3 are different from each other.

A step 5, the CPU 160 determines if the position difference amount is within a predetermined tolerance. If the result is YES, control jumps to step 12, so that sewing is performed with the feed pitch of the upper cloth piece 12 being kept as it is. On the other hand, if the result is NO, at step 6, the pulse motor 137 is rotated in the positive direction in accordance with the amount of difference in order to increase the cloth feed pitch of the upper-feed device.

This causes the feed control cam 138 to turn in the predetermined direction. Thus the operating shaft 139 is turned by the engagement between the cam 138 and the cam follower 141. This causes the turning angle of the turning shaft 130 and the feed regulator 131 to be changed in the direction in which the cloth feed pitch increases to thereby increase the cloth feed pitch of the upper-feed dog 99.

Under these conditions, the sewing machine continues to be operated, and portions forming the patterns 153 are sewed. At step 7, when the next patterns 153 pass through the cloth pattern sensing means 158, the means 158 outputs a voltage waveform signal SG2 corresponding to the patterns 153. At step 8, the CPU 160 determines if there is a difference of position as in step 4 and computes the amount of difference. Furthermore, the CPU compares the amount of difference between these patterns and that of difference between the previous patterns.

If the amount of the latter difference is larger than that of the former difference, the result of the determination at step 9 becomes YES. As a result, the direction of the difference is determined to be positive. At next step 10, the CPU 160 drives the pulse motor 137 in the reverse direction in accordance with the sensed amount of difference between the second patterns to reduce the feed pitch of the upper-side cloth 12. As a result, portions having the second patterns 153 are sewed in a difference-free state. If there is no increase in difference, it means that the direction of difference between the first patterns 153 is reversed, and that the direction to which the cloth feed pitch is changed, is correct. Thus at the next step 12, the cloth pieces are sewed with the feed pitch of the upper-side cloth piece 12 being kept as it is.

The steps 3–10 are repeated until the working of the pedal 161 is released to cause the start and stop signal generator 162 to output a stop signal, which then stops the machine motor 6. At this time, the result of the determination at step 11 becomes YES and sewing ends.

As described above, in this embodiment, the amount of difference of position between the patterns 153 on the cloth pieces 12 to be sewed is sensed before the portions having the patterns 153 are sewed and the feed pitch of the upper-side cloth piece 12 is changed in accordance with the amount of difference, so that the cloth pieces are sewed automatically in the state where the patterns 153 are in aligned positions. Thus no skill for this work is required. In addition, since the cloth pattern sensing means 158 includes a single light source 150 and a single light receiving element 151, the structure of this means is simple and manufactured inexpensively.

Another Embodiment

Next, a second embodiment of this invention will be described with reference to the drawings. This embodiment differs from the first embodiment in that as shown by two-dot dashed line in FIG. 12, a voltage waveform signal SG2 output from the cloth pattern sensing means 158 is input to a comparison circuit 170.

Figure 16:
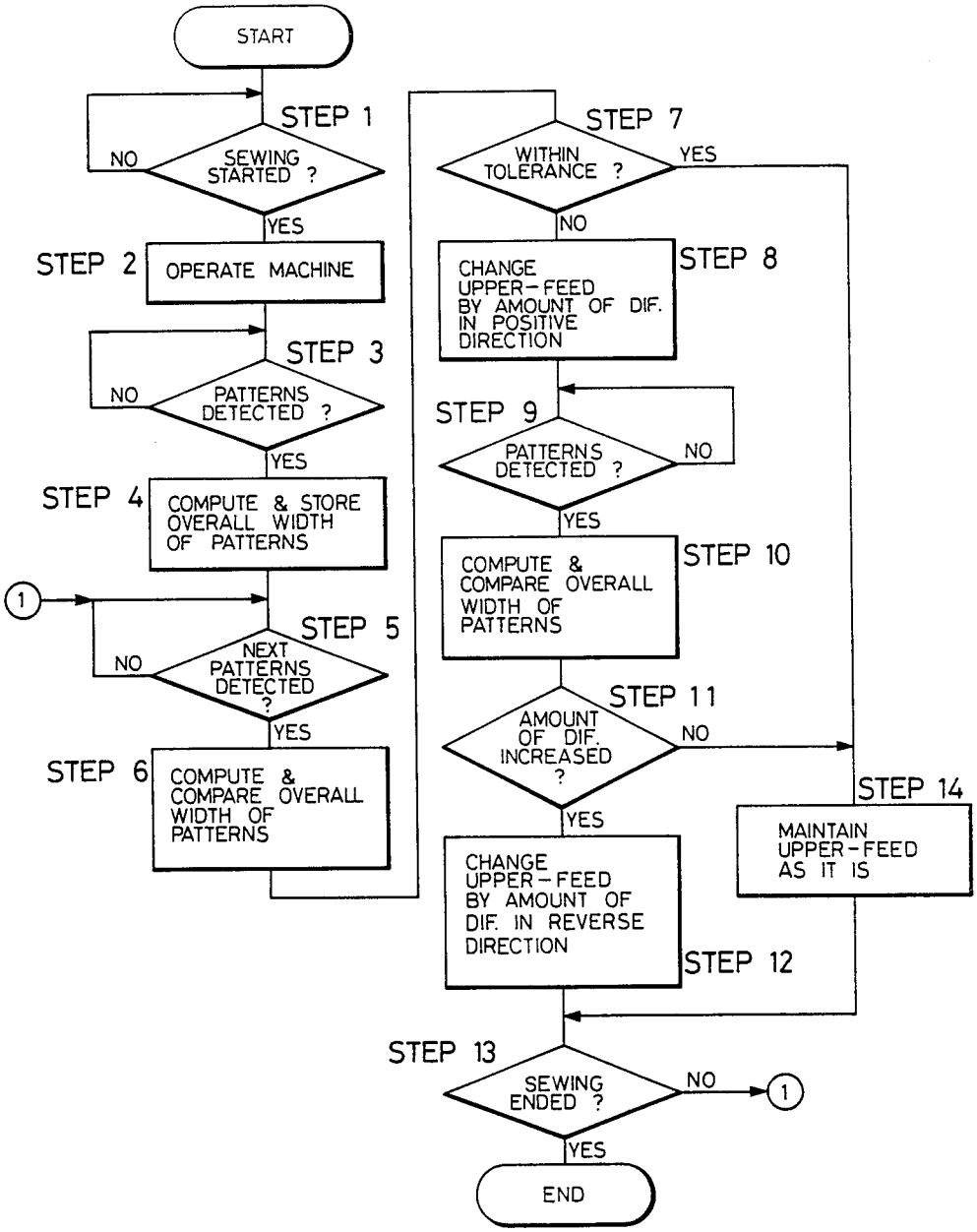
FIG. 16 is a flowchart of the operation order of the sewing machine and showing a second embodiment of this invention.

Thus, in this embodiment, two upper and lower cloth pieces 12 are set on the cloth support surface 10 with a pair of patterns 153 to be sewed on the cloth pieces 12 being aligned by an operator. Next as shown in FIG. 16, at step 1, a start signal is input to the CPU 160 and at step 2, the machine is operated. When the respective patterns 153 of the cloth pieces 12 pass through the cloth pattern sensing means 158 due to the machine operation, the result of the determination at step 3 becomes YES and the sensing means 158 outputs a voltage waveform signal SG2. This signal SG2 is processed by the comparison circuit 170 and is converted to a signal SG4, as shown by two-dot dashed line in FIG. 15, which signal is input to the CPU 160.

At step 4, the overall width of the previously aligned patterns 153 is computed on the basis of signal SG40 shown in FIG. 14. Namely, the input number of synchronous signals SG1 until the rise and fall of signal SG40 are counted on the basis of the needle lower-position signal, and computes the percentages m1, m3 of cloth feed pitch at the fall and rise of the signal SG40 from data on the cloth feed pitch stored in the ROM 167. The CPU 160 computes an overall pattern width y on the basis of the equation $y=(m3-m1)\cdot p$ from the computed data and the data on the quantity of cloth feed (pitch, p) input from the potentiometer 80 and stores the result of the computation in the RAM 168.

When the next patterns 153 pass through the cloth pattern sensing means 158 and the result of determination at step 5 becomes YES, at step 6, the CPU 160 computes the overall pattern width y for the next patterns 153 on the basis of the signal SG41 (see FIG. 14) and the previous equation. The CPU 160 compares the overall width of the second patterns and the reference width for the first patterns and computes the amount of difference of position and stores it in the RAM 168. As a result, if the amount of difference exceeds a predetermined value, the result of the determination at step 7 becomes NO and control passes to the next step 8.

As will be obvious from the above description, in this embodiment, after the overall width of the patterns 153 is computed on the basis of the signal SG4, the amount of difference is computed. Thus the processing at the following steps 8–14 is only different from steps 6–12 in FIG. 13 in the first embodiment in the processing of voltage waveform signal SG2 and the computation of the amount of difference.

Thus also in this embodiment, as in the first embodiment, the amount of difference of position between patterns 153 on the cloth pieces 12 to be sewed is sensed before the portions having the patterns 153 are sewed, and the feed pitch of the upper-side cloth piece 12 is changed in accordance with the sensed amount of difference. Thus, automatic sewing is performed with the patterns 153 on the upper and lower cloth pieces 12 being in aligned positions. Thus no skill for the work is required. In addition, the cloth pattern sensing means 158 is composed of a single light source 150 and a single light receiving element 151, so that it is simple in structure and manufactured inexpensively.

Next, a third embodiment of this invention will be described mainly concerning the difference between this embodiment and the second embodiment and with reference to the drawings.

In this embodiment, as shown in two-dot dashed lines in FIG. 12, a comparison circuit 170 similar to that in the second embodiment is provided. In addition, a storage key 172 which sets a mode for storing consecutive pattern data on patterns 153, and a reproduction key 173 which sets a mode for maintaining correct alignment of a pattern and performing a sewing operation on the basis of the stored consecutive pattern data on the patterns 153 are provided on a control panel 171 provided on the front of the arm portion 2 of the machine frame 1.

Figure 17:
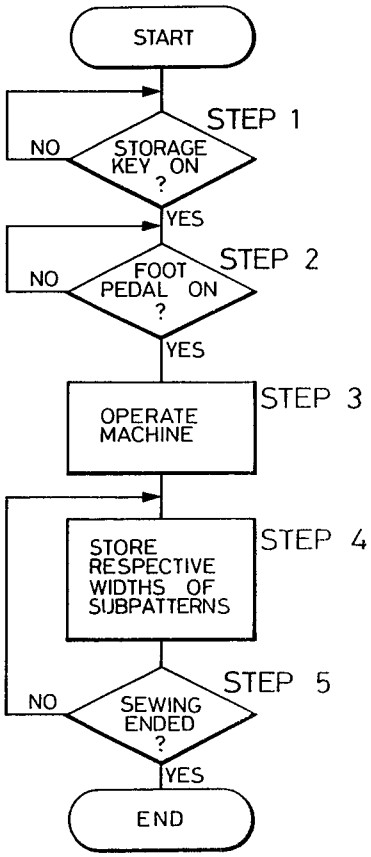
FIGS. 17–19 show a third embodiment of this invention.
Figure 19:
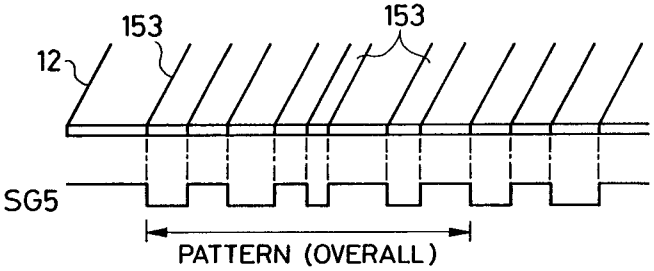

Thus in this embodiment, as shown in FIG. 19, when two cloth pieces 12, each of which has patterns disposed at constant spacings, each pattern including a plurality of subpatterns having different widths, are to be sewed while maintaining correct alignment of a pattern, first, a cloth piece 12 is set on the cloth support surface 10 and the storage key 172 is operated at step 1 shown in FIG. 17 to store the pattern data. The CPU 160 then sets the storage mode.

At step 2, the foot pedal 161 is depressed, and at step 3, the machine is operated. Thus each time each of subpatterns 153 constituting a pattern passes through the cloth pattern sensing means 158, this means 158 generates a voltage waveform signal SG2 which is then converted by the comparison circuit 170 to a signal SG5 which in turn is input to the CPU 160.

At step 4, the width data on the respective subpatterns 153 is sequentially stored in the RAM 168. When the storing of width data for one pattern is ended and the working of the pedal 161 is released, the result of the determination at step 5 becomes YES and the operation of the machine and the storing of the pattern widths are stopped.

Figure 18:
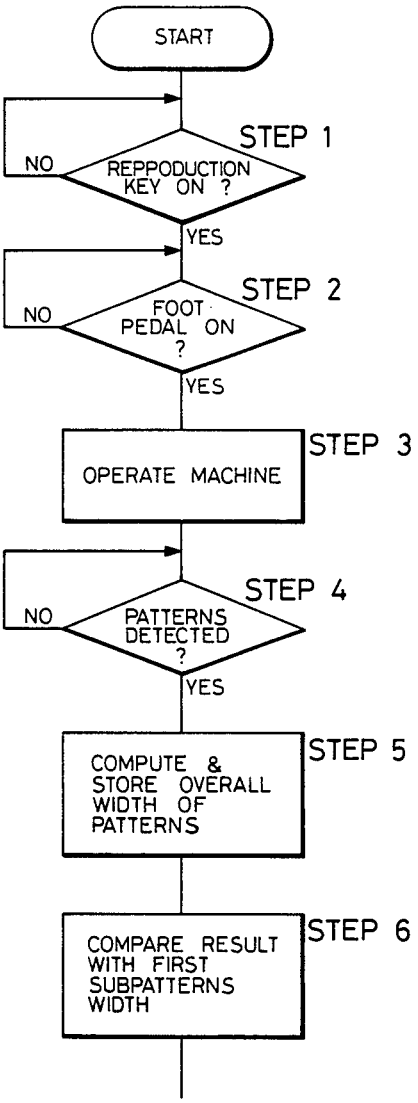
Figure 20:
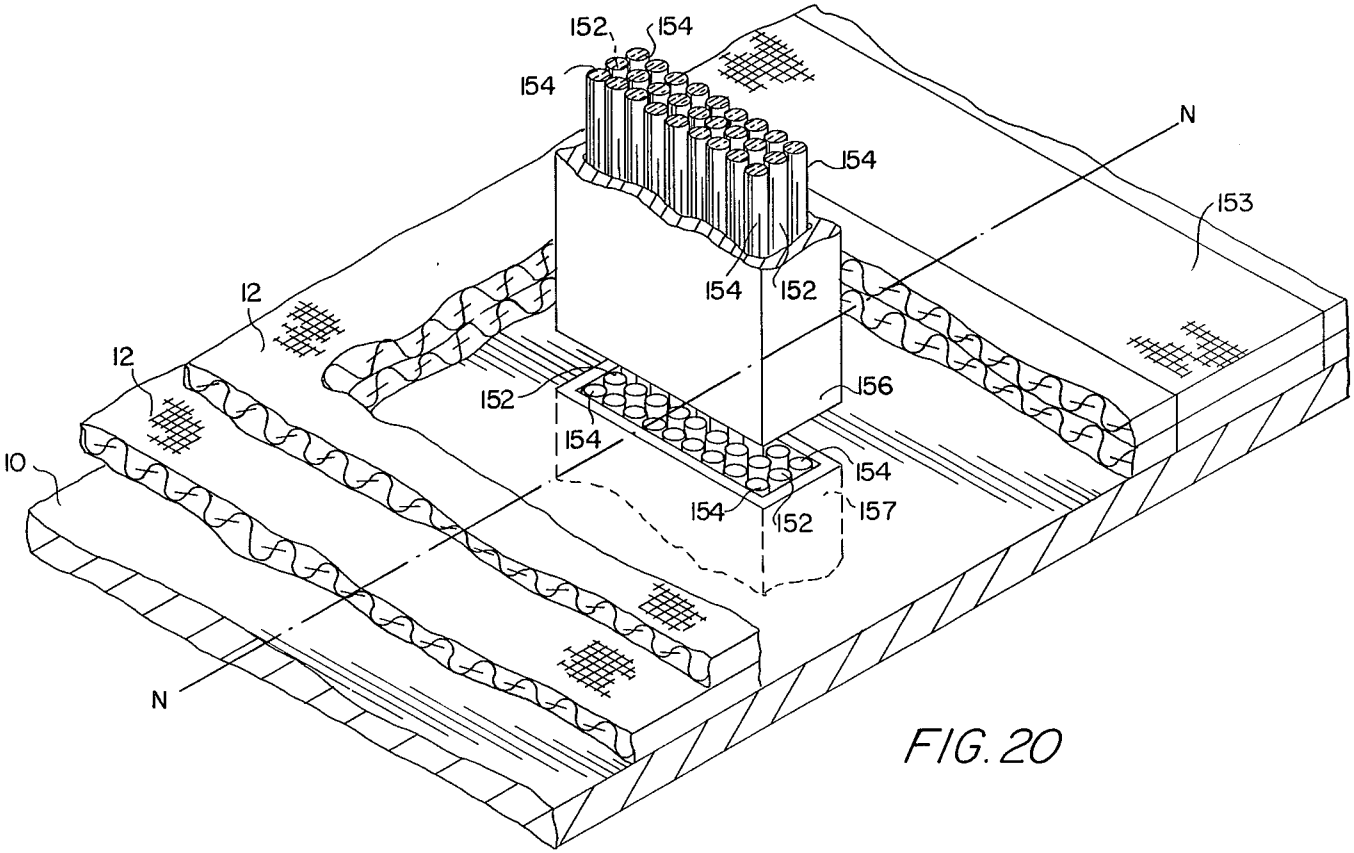
FIG. 20 is a perspective view of the cloth pattern sensing means in relation to the cloth.

Next, in order to sew the two cloth pieces 12, the two cloth pieces 12 are set on the cloth support surface 10 with the first subpatterns 153 included in the pattern being disposed on the upstream side of the sensing means 158. Then at step 1 shown in FIG. 18, the reproduction key 173 is pressed and at step 2, the pedal 161 is depressed. Control then passes to step 3 where the machine is operated. At step 4, when it is determined that the first subpatterns 153 have passed the sensing means 158, at step 5, the CPU 160 computes the overall width of the overlapping subpatterns 153 on the basis of the voltage waveform signal SG2 from the sensing means 158 as in the second embodiment. At step 6, the CPU compares the computed result and the subpattern width data on the first subpattern in the subpattern data stored by the previous operation to computes the amount of difference of position.

Thereafter, processing similar to steps 7–14 shown in FIG. 16 for the second embodiment is performed and the feed pitch of the upper-cloth piece 12 is changed in accordance with the amount of difference, and the portions forming the subpatterns 153 are sewed. In this embodiment, each time the subpatterns 153 on upper and lower cloth pieces 12 pass through the sensing means 158, the supattern width data to be compared is updated and read out of the RAM 168. The amount of the difference is computed on the basis of the updated data and the data on subpattern alignment width from the sensing means 158, and sewing is performed under the condition where the feed pitch of the upper-side cloth piece has been changed in accordance with the computed amount of difference.

Therefore, as in the previous embodiment, this embodiment does not require a skill for pattern correct sewing. In addition, the cloth pattern sensing means is simple in structure and manufactured inexpensively.

Further, a fourth embodiment of this invention will be described with reference to FIG. 10(*b*) and FIG. 15(*b*).

As shown in FIG. 10(*b*), according to this embodiment, the density of optical fibers of the light receiving side light guide means 152 of the upper light projecting and receiving unit 156 is higher than that of optical fibers of the light receiving side light guide means of the lower light projecting and receiving unit 157. Accordingly, as shown in FIG. 15(*b*), when the pattern on the upper cloth piece goes ahead of that on the lower cloth piece, two consecutive signals SG3 having the same polarity are output from the differentiating circuit 164, the former of which is larger in the absolute value than the latter. On the other hand, the pattern on the upper cloth piece goes behind that on the lower cloth pattern, the former of two consecutive signals SG3 having the same polarity is smaller in the absolute value than the latter of the signals. Therefore, it is possible to discriminate the direction of the difference of position between the patterns by detecting the value of the consecutive two signals SG3.

It is to be noted that this invention is not limited to the previous embodiments. Many changes and modifications may be made by those skilled in the art without departing from the scope of the invention. For example, when a difference of position occurs, first, the feed adjusting device may be operated so that the feed pitch of the upper-side cloth piece is decreased.

According to the fourth embodiment, it is not necessary to temporarily increase or decrease an upper feed pitch to determine the direction of difference between patterns unlike the first, second and third embodiments.

As described in detail above, according to this invention, when a difference occurs between any patterns, the feed adjusting device is adjusted on the basis of data on the percentage of the amount of difference of position between the patterns and data on the cloth feed pitch from the feed sensors in one direction so that said amount of difference either increases or decreases to thereby change the cloth feed pitch of the feed device. Data on the amount of difference of position between any patterns is compared with that on the amount of difference of position between the next patterns, when the changing of the cloth feed pitch occurs, to compute the direction in which the amount of difference increases or decreases, namely, the direction of the difference. The feed adjusting device is adjusted in the direction in which the amount of difference decreases, On the basis of the result of the computation. The feed adjusting device is stopped when the amount of difference falls within the tolerance. Consequently, the two upper and lower pieces of cloth having the same pattern can be sewed easily and steadily with the patterns being aligned. No skill for the work is required. The machine is simple in structure and manufactured inexpensively.

Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

What is claimed is:

1. A sewing machine, comprising:

stitch forming means including a needle movable up and down through a cloth support surface for sewing together upper and lower cloth pieces overlapping each other, said cloth pieces having the same pattern;

upper feeding means arranged above said cloth support surface for feeding the upper cloth piece, said upper feeding means being actuated synchronously with said stitch forming means;

lower feeding means arranged below said cloth support surface for feeding the lower cloth piece, said lower feeding means being actuated synchronously with said stitch forming means;

feed adjusting means for adjusting a feed pitch of at least one of said upper and lower feeding means;

cloth pattern sensing means for generating sensing signals, said cloth pattern sensing means being disposed at an upstream side of said stitch forming means and including a single light source irradiating said cloth pieces and a single light receiving element receiving composed rays of transmitted light or reflected light from said cloth pieces;

differentiating means for differentiating said sensing signals to produce differential signals;

arithmetic means for calculating a position difference amount between said patterns on said cloth pieces on the basis of polarities of two consecutive signals generated from said differentiating means and the timing of the occurrence of said signals; and control means for aligning said patterns on said cloth pieces by controlling said feed adjusting means on the basis of the position difference amount between said patterns calculated by said arithmetic means.

2. A sewing machine as claimed in claim 1, wherein said cloth pattern sensing means includes light projecting side light guide means of optical fibers disposed between a predetermined position on each of said cloth pieces and said light source to irradiate each of said cloth pieces by divided rays of light from said light source, and light receiving side light guide means of optical fibers disposed between said predetermined position on said cloth pieces and said light receiving element to guide reflected rays of light from said cloth pieces to said light receiving element.

3. A sewing machine as claimed in claim 1, wherein said control means first increases or decreases a feed pitch of said upper or lower feeding means when a difference of position between said patterns is determined, and then said control means increases or decreases a feed pitch of said upper or lower feed means on the basis of comparison between the next calculated amount of difference and the previously calculated amount of difference.

4. A sewing machine as claimed in claim 1, further comprising feed pitch sensing means for sensing either feed pitch of said upper and lower feeding means, wherein said arithmetic means calculates the position difference amount between said patterns by counting the number of input synchronous signals until two differentiation signals occur, computing the percentage of cloth feed pitch at the time when said each differentiation signal is produced, and calculating the computed data and data on a cloth feed pitch input from said feed pitch sensing means.

5. A sewing machine as claimed in claim 2, wherein said light receiving side light guide means guides the reflected ray of light from the lower one of said two cloth pieces in a different percentage to that from the upper one of said two cloth pieces to said light receiving element, and said control means increases or decreases a feed pitch of said upper or lower feed means in accordance with the value of said sensing signal at a first step which varies in two steps.

6. A sewing machine, comprising:

stitch forming means including a needle movable up and down through a cloth support surface for sewing together upper and lower cloth pieces overlapping each other, said cloth pieces having the same pattern;

upper feeding means arranged above said cloth support surface for feeding the upper cloth piece, said upper feeding means being actuated synchronously with said stitch forming means;

lower feeding means arranged below said cloth support surface for feeding the lower cloth piece, said lower feeding means being actuated synchronously with said stitch forming means;

feed adjusting means for adjusting a feed pitch of at least one of said upper and lower feeding means;

feed pitch sensing means for sensing either feed pitch of said upper and lower feeding means;

cloth pattern sensing means for generating sensing signals, said cloth pattern sensing means being disposed at an upstream side of said stitch forming means and including a single light source irradiating said cloth pieces and a single light receiving element receiving composed rays of transmitted light or reflected light from said cloth pieces;

arithmetic means for calculating a position difference amount between said patterns on said cloth pieces on the basis of the difference between a period in which said sensing signals are varied as said sensing means senses said patterns overlapping on said cloth pieces and a reference period in which said sensing signals are varied under the condition that no difference of position between said patterns exists; and control means for adjusting said feed adjusting means when a position difference occurs between any corresponding patterns, said control means adjusting said feed adjusting means by evaluating data on the position difference amount and data on the cloth feed pitch from said feed pitch sensing means in one direction so that the position difference amount either increases or decreases to change the feed pitch of one of said upper and lower said feeding means, comparing data on the position difference amount between any patterns with the position difference amount between the next patterns to compute the direction of the position difference amount, adjusting said feed adjusting means in the direction in which said position difference amount decreases on the basis of the result of the computation, and stopping said feed adjusting means when the position difference amount falls within a selected tolerance.

7. A sewing machine as claimed in claim 6, wherein said reference period is such a period in which said sensing singal is varied by the first sensed patterns after the start of sewing.

8. A sewing machine as claimed in claim 6, wherein said reference period is set and stored at memory mode by sewing said two cloth pieces overlapped to each other in an aligned position, and the difference of position between said patterns on said two cloth pieces is corrected at reproducing mode.

9. A sewing machine comprising;

stitch forming means including a needle movable up and down through a cloth support surface for sewing together of two cloth pieces overlapped each other, said cloth pieces having the same pattern, respectively;

upper feeding means arranged over said cloth support surface for feeding the upper cloth piece, said upper feeding means being actuated synchronously with said stitch forming means;

lower feeding means arranged under said cloth support surface for feeding the under cloth piece, said lower feeding means being actuated synchronously with said stitch forming means;

feed adjusting means for adjusting at least one of feed pitches of said upper and lower feeding means;

feed pitch sensing means for sensing either feed pitch of said upper and lower feeding means;

cloth pattern sensing means for generating sensing signals, said cloth pattern sensing means being disposed at an upstream side of said stitch forming means and including a single light source irradiating said cloth pieces, a single light receiving element receiving composed rays of transmitted light or reflected light from said two cloth pieces, light projecting side light guide means disposed between a predetermined position on each of said two cloth pieces and said light source to irradiate each of said two cloth pieces by divided rays of light from said single light source, and light receiving side light guide means disposed between said predetermined position and said light receiving element to guide reflected rays of light from said two cloth pieces, said light receiving side light guide means guiding the reflected ray. of light from the lower one of said two cloth pieces in a different percentage to that from the upper one of said two cloth pieces to said light receiving element;

arithmetic means for calculating the amount of difference of position between said patterns on said two cloth pieces on the basis of difference between a period in which said sensing signals are varied as said sensing means senses said patterns overlapped on said two cloth pieces and a reference period in which said sensing signals are varied under the condition that no difference of position between said patterns exists; and control means for aligning said patterns on said two cloth pieces by controlling said feed adjusting means on the basis of the amount of difference of position between said patterns calculated by said arithmetic means, said control means increasing or decreasing a feed pitch of said upper or lower feeding means in accordance with the value of said sensing signal at a first step which varies in two steps.

* * * * *

UNITED STATES PATENT AND TRADEMARK OFFICE

CERTIFICATE OF CORRECTION

PATENT NO. : 4,777,896

DATED : October 18, 1988

INVENTOR(S) : Etsuzo Nomura

It is certified that error appears in the above-identified patent and that said Letters Patent is hereby corrected as shown below:

Figure 11, should appear as shown below:

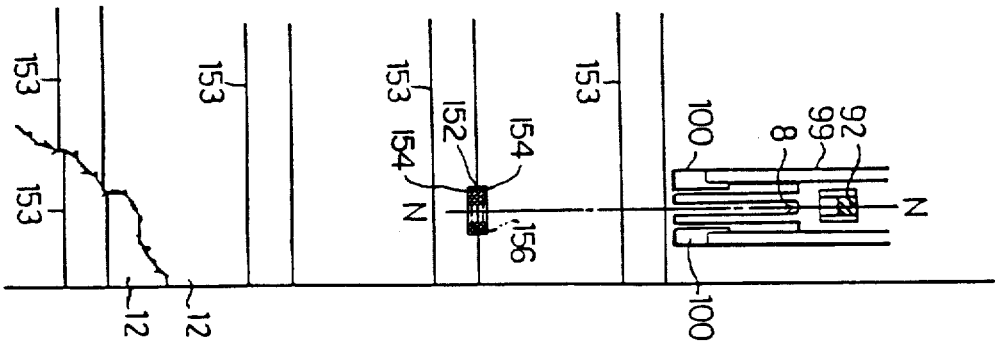

FIG. 11

Signed and Sealed this

Twelfth Day of September, 1989

*Attest:*

DONALD J. QUIGG

*Attesting Officer*

*Commissioner of Patents and Trademarks*